US005709544A

United States Patent [19]

Wurtz

[11] Patent Number: 5,709,544

[45] Date of Patent: Jan. 20, 1998

[54] DUAL SEAL FOR A VACUUM HEAT TREATING FURNACE

[75] Inventor: Brian J. Wurtz, Levittown, Pa.

[73] Assignee: Abar Ipsen Industries, Inc., Bensalem, Pa.

[21] Appl. No.: 639,033

[22] Filed: Apr. 16, 1996

[51] Int. Cl.[6] ..... F27D 1/18

[52] U.S. Cl. ..... 432/242; 432/77; 432/115; 432/233; 432/205; 415/110; 415/111

[58] Field of Search ..... 432/115, 205, 432/206, 242, 244, 233, 77; 34/242; 415/110, 111, 112

[56] References Cited

U.S. PATENT DOCUMENTS

| | | | |
|---|---|---|---|
| 3,843,140 | 10/1974 | Mayer et al. | 415/110 |
| 4,451,200 | 5/1984 | Libertini et al. | 415/111 |
| 4,818,222 | 4/1989 | Docherty et al. | 432/242 |
| 4,846,675 | 7/1989 | Soliman | 432/206 |
| 4,906,182 | 3/1990 | Moller | 432/77 |
| 5,173,045 | 12/1992 | Macri | 432/115 |

*Primary Examiner*—Henry A. Bennett
*Assistant Examiner*—Jiping Lu
*Attorney, Agent, or Firm*—Dann, Dorfman, Herrell and Skillman, P.C.

[57] ABSTRACT

A vacuum heat treating furnace includes a pressure vessel having a wall that defines a chamber wherein metal parts are vacuum heat treated. A fan is disposed inside the chamber for circulating a cooling gas therein. An electric motor is mounted externally to the pressure vessel for driving the fan. A drive shaft interconnects the fan and the electric motor through an opening in the wall of the pressure vessel. The vacuum furnace incorporates a dual seal for providing a vacuum-tight seal and a gas-tight seal where the drive shafts passes through the pressure vessel wall. The dual seal includes an inflatable seal surrounding the drive shaft for providing a vacuum-tight seal around said drive shaft when the furnace chamber is evacuated to a subatmospheric pressure. The dual seal also includes one or more lip seals surrounding the drive shaft adjacent to said inflatable seal for providing a gas-tight seal around said drive shaft when the furnace chamber is backfilled with a superatmospheric pressure of the cooling gas and while the drive shaft is rotating.

25 Claims, 4 Drawing Sheets

DUAL SEAL FOR A VACUUM HEAT TREATING FURNACE

FIELD OF THE INVENTION

This invention relates to a vacuum furnace for heat treating metal parts, and in particular, to a vacuum heat treating furnace having an internal gas-circulation fan, an external motor for driving the fan, and a dual seal arrangement for providing a vacuum-tight seal and a gas-tight seal around the fan drive shaft where it penetrates the furnace wall.

BACKGROUND OF THE INVENTION

Many models of the known vacuum heat treating furnaces have an internal gas quenching system. Such gas quenching systems include an internal fan for circulating an inert cooling gas over the heated metal parts and through an internal heat exchanger. Commercially available embodiments of such furnaces also have an internally mounted electric motor for driving the gas circulation fan. An example of such a furnace is that sold under the registered trademark "TURBO TREATER" by Abar Ipsen Industries, Inc., assignee of the present application.

The interior of a vacuum heat treating furnace is subject to extreme temperature and pressure conditions. Depending on the type of material being heat treated, the interior of the furnace can reach a temperature of up to 3000° F., be evacuated to a vacuum of down to $10^{-5}$ torr, and be backfilled with inert gas up to a pressure of up to 6 bar. Under such operating conditions, the useful life of most electric motors is severely curtailed resulting in costly maintenance, repair or replacement, and furnace downtime. Although the construction of the electric motors used in the known vacuum heat treating furnaces has been modified in various ways to overcome the problems associated with the extreme conditions encountered in such furnaces, none of the modifications have proven entirely satisfactory. The design modifications that work best are also the most expensive to implement. Lower cost modifications have not provided a reliable solution to the problem.

A desirable alternative to locating the fan drive motor inside the furnace vessel is to locate it externally where it is not subject to the temperature and pressure extremes encountered inside the furnace vessel. However, in order to locate the fan drive motor outside the furnace vessel, it is necessary to provide an effective seal where the drive shaft penetrates the furnace pressure vessel wall. The problem is to effectively provide a vacuum-tight seal for a vacuum as low as $10^{-5}$ torr, as well as to provide a gas-tight seal that is capable of sealing against a gas pressure of up to 6 bar or higher.

SUMMARY OF THE INVENTION

The problems associated with the known vacuum furnace fan drive arrangements are solved to a large degree by a vacuum heat treating furnace in accordance with the present invention. In accordance with one aspect of the present invention there is provided a pressure vessel having a wall that defines a chamber. A fan is disposed inside the chamber for circulating a cooling gas therein. Motive means disposed externally to the pressure vessel is provided for rotating the fan. A drive shaft interconnects the fan and the motive means through an opening in the wall of the pressure vessel. A dual seal is disposed around the drive shaft where it penetrates the vessel wall and is constructed and arranged for providing a vacuum-tight seal and a gas-tight seal around said drive shaft. This dual seal includes an inflatable seal surrounding the drive shaft and a lip seal surrounding said drive shaft adjacent to the inflatable seal. The inflatable seal is formed for providing a vacuum-tight seal around said drive shaft when inflated and the lip seal is formed for providing a gas-tight seal around the drive shaft when the gas pressure in the chamber is raised to a superatmospheric pressure. In accordance with another aspect of the present invention, there is provided a dual seal arrangement that can be readily used to retrofit an existing vacuum furnace having an internally mounted motor.

BRIEF DESCRIPTION OF THE DRAWINGS

Further objects and advantages of the present invention will become apparent from the following detailed description and the accompanying drawings, of which.

DETAILED DESCRIPTION

Figure 1:
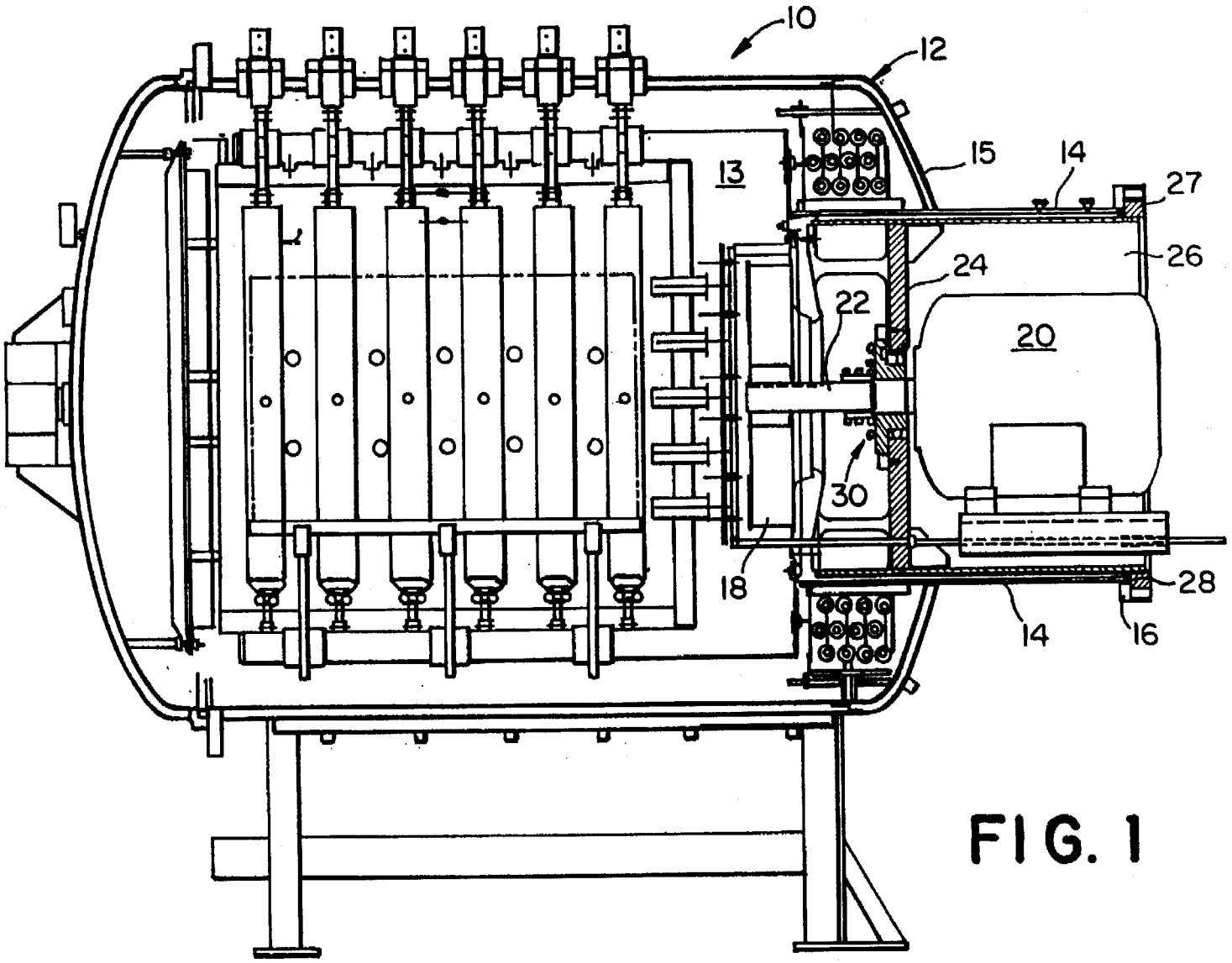
FIG. 1 is a side elevation view in partial section of a vacuum heat treating furnace in accordance with the present invention.
Figure 2:
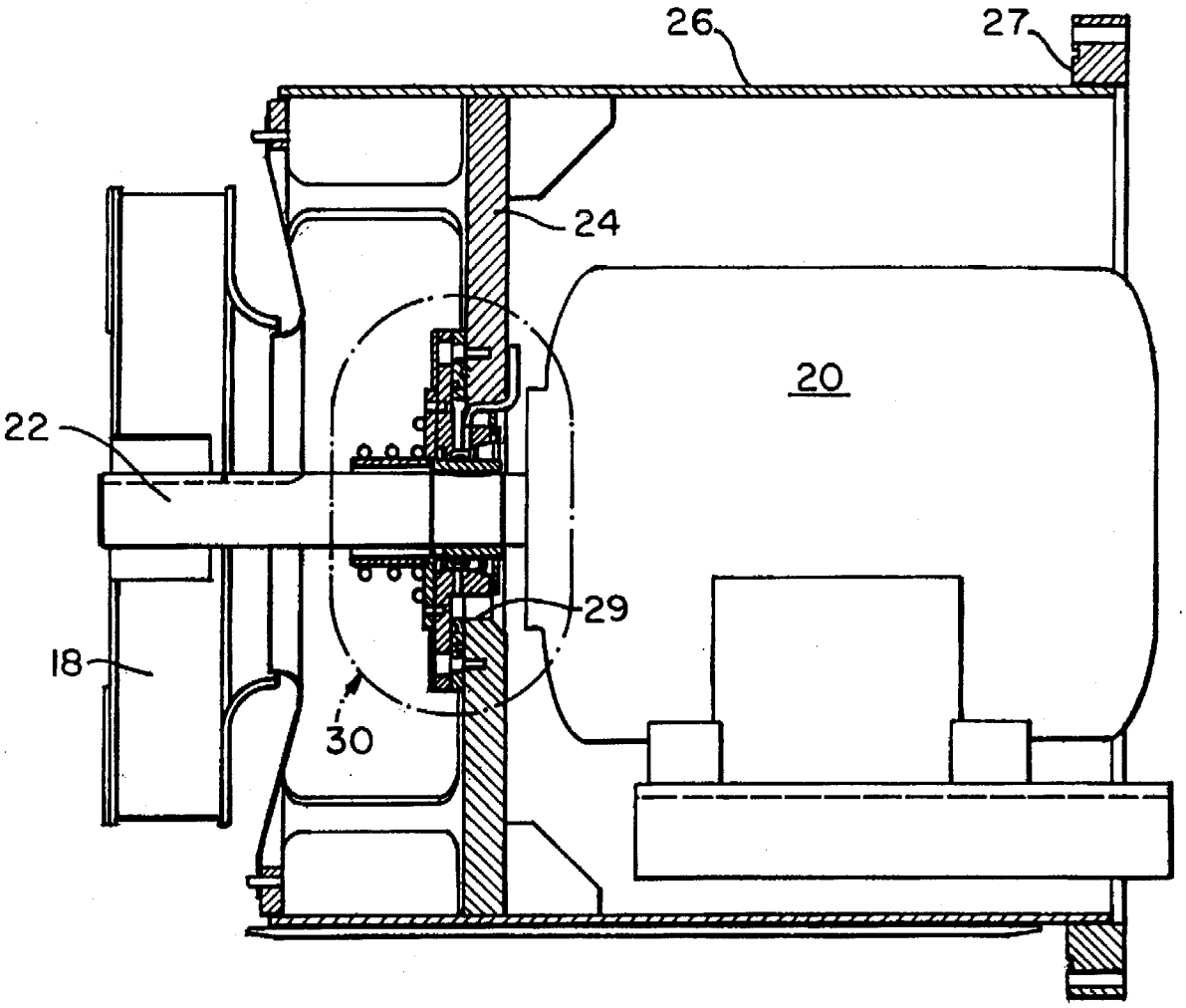
FIG. 2 is an enlarged elevation view in partial section of a motor/fan assembly used in the vacuum heat treating furnace shown in FIG. 1.

Referring now to the drawings wherein the same reference numerals refer to the same or similar components across the several views, and in particular to FIGS. 1 and 2, there is shown a vacuum heat treating furnace 10 in accordance with the present invention. The vacuum heat treating furnace 10 includes a pressure vessel 12 which encloses a chamber 13 wherein metal parts are heat treated. Pressure vessel 12 has a generally cylindrical receptacle 14 formed through pressure vessel end wall 15. The receptacle 14 has an open end and a flange 16 formed about the periphery of the open end.

A forced gas cooling system is provided in the vacuum furnace 10 for directing a cooling gas over metallic workpieces that are heated in the furnace. The cooling gas is an inert gas such as nitrogen or argon, and can also be helium, or a mixture of helium and hydrogen. The gas cooling system includes a gas circulating fan 18 and a drive motor 20 which is connected to the fan 18 by a drive shaft 22. The motor 20 is mounted outside the pressure vessel 12 in a generally cylindrical housing 26 which is dimensioned to fit within the cylindrical receptacle 14. In a vacuum heat treating furnace that operates at very high temperatures, e.g., 2000°–3000° F., the motor 20 is preferably mounted at a distance from the pressure vessel 12. In such an embodiment the motor 20 is coupled to the drive shaft 22 by means of a mechanical linkage such as a drive belt and sheave arrangement, a chain and sprocket arrangement, or a gear drive arrangement.

The cylindrical housing 26 has a flange 27 that interfaces with flange 16 on the receptacle 14. Cylindrical housing 26 is affixed to receptacle 14 by means of suitable fasteners through the flanges 16 and 27. An o-ring 28 is disposed between flanges 16 and 27 to provide a vacuum-tight seal when the fasteners are fully tightened.

A support plate 24 is disposed within the housing 26 to provide a wall or bulkhead between chamber 13 and the ambient environment outside pressure vessel 12. The support plate 24 has an opening 29 through which the drive shaft 22 extends into chamber 13. A dual seal arrangement 30 is disposed in opening 29 and is supported by the support plate 24 around the drive shaft 22 to provide a vacuum-tight seal and a gas-tight seal.

Figure 3:
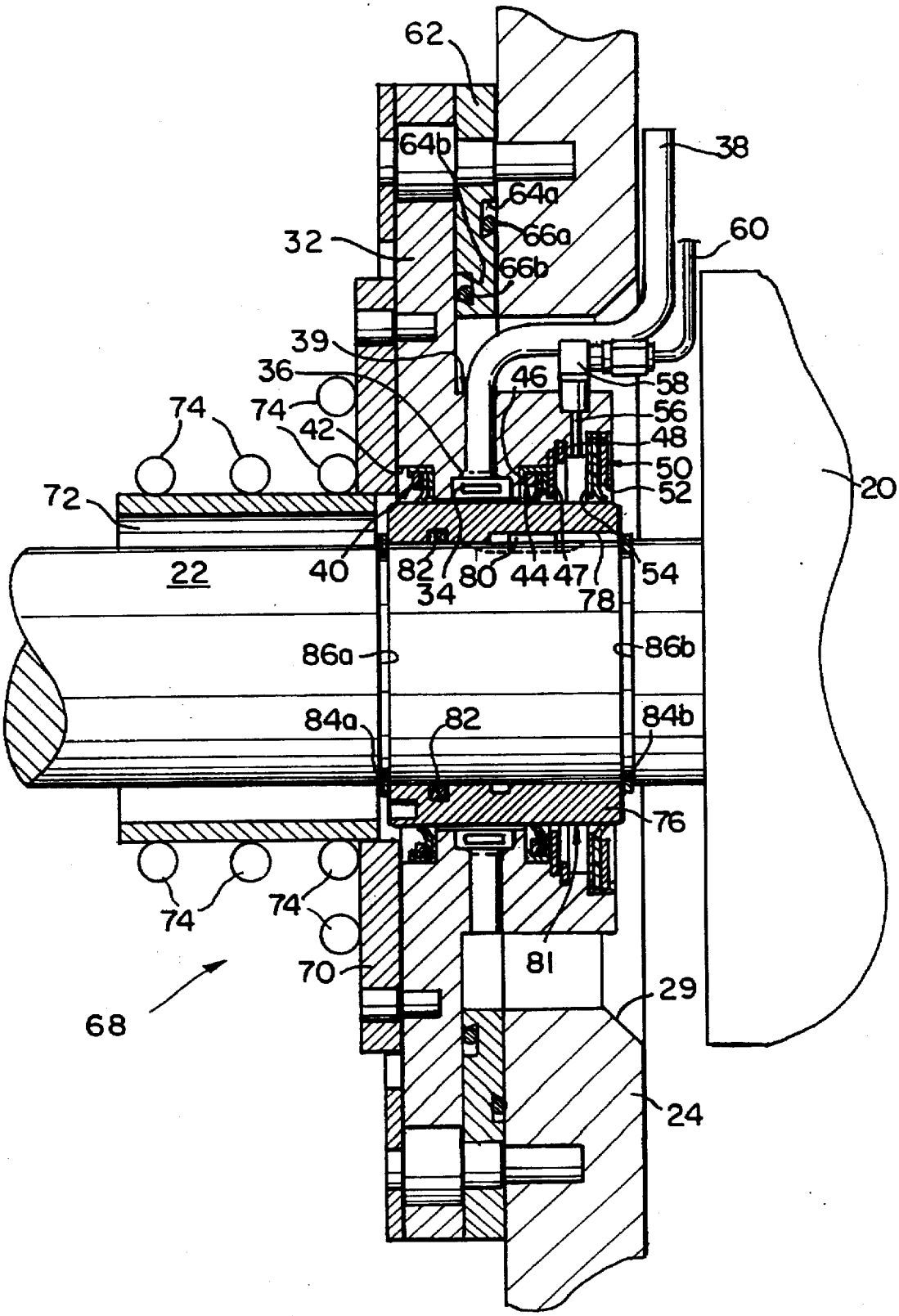
FIG. 3 is a detail elevation view in partial section of the dual seal arrangement used in the motor/fan assembly shown in FIG. 2.

Referring now to FIG. 3, the dual seal arrangement 30 is illustrated in greater detail. A retaining plate 32 that is attached to support plate 24 by suitable fasteners, has a central opening defined by a generally cylindrical wall having a plurality of circumferential grooves or recesses formed therein. A first recess 36 formed in retaining plate 24 holds an inflatable seal 34. The inflatable seal 34 is a generally ring-shaped tube preferably formed of fabric reinforced silicone or another impermeable, flexible material which can be inflated with a gas. The tube can have any suitable cross section, but is preferably rectangular or oval in cross section. The cross section of the inflatable seal is dimensioned to fit within recess 36 and be clear of the drive shaft 22 when the seal is deflated. When the inflatable seal 34 is inflated, it expands beyond the limits of recess 36 to form a vacuum-tight seal. The inflatable seal 34 has an inlet/outlet tube 38 to permit the inflatable seal 34 to be inflated with a pressurized gas and also to be deflated. A suitable type of inflatable seal is that sold under the registered trademark "PNEUMA-SEAL" by Presray Corporation of Pawling, N.Y. The inlet/outlet tube 38 passes through a port 39 formed in the retaining plate 32 and through opening 29 to connect with an inflation/deflation system.

An inboard lip seal 40 is retained in a second recess 42 formed in retaining plate 32 inboard of recess 36. The inboard lip seal 40 provides a pressure-tight or gas-tight seal about shaft 22. An intermediate lip seal 44 is retained in a further recess 46 outboard of the inflatable seal 34 relative to the inboard lip seal 40. A backing plate 47 and internal retaining ring 48 are provided for holding the intermediate lip seal 44 in position in recess 46. An outboard lip seal 50 is retained in an outboard recess 52 for providing a further gas-tight seal around drive shaft 22.

An annular chamber 54 is formed in the retaining plate 32 between the intermediate recess 46 and the outboard recess 52. A vacuum port 56 communicates with the annular chamber 54 and a vacuum fitting 58 to which vacuum tubing 60 is connected. The vacuum tubing 60 extends to the furnace vacuum system. This arrangement permits the annular chamber 54 to be evacuated when the furnace chamber 13 is under vacuum so that the pressure differential across the inflatable seal 34 is reduced.

The drive shaft 22 is preferably lubricated with a suitable lubricant. Suitable lubricants are those that provide acceptable lubrication of the drive shaft 22 during operation under the elevated temperature and pressure conditions the occur during a heat treating cycle. If desired, a second port, fitting, and tubing (not shown) can be provided in retaining plate 32 so that a lubricant can be injected into the annular chamber 54 for lubricating drive shaft 22 when it is rotating.

A sealing surface sleeve 76 is fitted over the portion of the drive shaft 22 disposed within the dual seal assembly 30. The sealing surface sleeve 76 has a key slot 78 for mating with a key 80 on drive shaft 22 whereby sleeve 76 is caused to rotate with drive shaft 22. A sealing ring 82 is provided in the sealing surface sleeve 76 for providing a vacuum tight seal between the sealing surface sleeve 76 and drive shaft 22. The sealing surface sleeve 76 has a very hard surface 81 which is highly finished, preferably to about 8 RMS. The surface 81 is preferably hardened with a thin coating of a very hard material, such as chromium III oxide ($Cr_2O_3$), to provide a surface hardness on the order of 71 HRC. The coating is preferably applied by a spray deposition technique such as plasma spraying. The combination of hardness and smoothness of the surface 81 provides an excellent contact surface for the inflatable seal 34 and the lip seals 40, 44, and 50 and also provides very good wear resistance for long life. It will be appreciated that the sealing surface sleeve 76 is easily replaceable and prevents scoring and wearing of the drive shaft 22 itself. The sealing surface sleeve 76 is held in place by an inboard retaining ring **84*a* and an outboard retaining ring 84*b* which fit in inboard recess 86*a* and outboard recess 86*b*, respectively, formed in the drive shaft 22**.

A gasket plate 62 which is disposed between the retaining plate 32 and the support plate 24 has two annular recesses **64*a* and 64*b* formed on opposite faces thereof. 0-rings 66*a* and 66*b* are provided in the recesses 64*a* and 64*b*, respectively, for providing a vacuum tight seal between the support plate 24 and retaining plate 32. A heat transfer assembly 68 is also provided for removing heat from the dual seal arrangement 30. The heat transfer assembly 68 includes a cooling plate 70 which is affixed to the retaining plate 32 by suitable fasteners. A collar 72 is affixed to the cooling plate 70 and surrounds a short portion of shaft 22 adjacent to the dual seal 30. Coils of tubing 74 are wrapped around and affixed to the cooling plate 70 and cooling collar 72** for conducting a cooling medium such as water.

Figure 4:
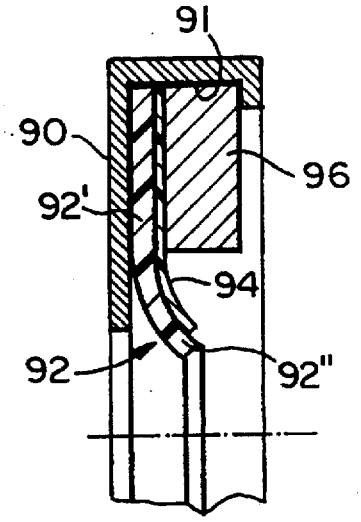
FIG. 4 is a detail view in partial section of a lip seal of the type used in the dual seal arrangement shown in FIG. 3.

Referring now to FIG. 4, there is shown in greater detail a lip seal of the type used in the dual seal assembly according to the present invention. The lip seal includes a ring-shaped case 90 having an internal channel 91 formed therein. A sealing lip 92, gasket 94, and spacing ring 96 are retained within the channel 91. The spacing ring 96 is dimensioned to provide a tight fit between sealing lip 92, gasket 94, and case 90, thereby restraining sealing lip 92 against lateral movement within channel 91. The sealing lip 92 has a retaining portion 92 which is disposed in the case 90 and a curved portion 92 which extends beyond the inner diameter of case 90 to contact with the drive shaft 22 in sealing engagement. The gasket 94 is disposed between the sealing lip 92 and the spacing ring 96 to prevent gas leakage between the sealing lip 92 and the spacing ring 96 when the lip seal is under pressure. A preferred design for the lip seal is that sold under the designation "VARILIP" by American Variseal Corporation of Broomfield, Colo. In the preferred embodiment, the case 90 is formed of a stainless steel alloy, the spacing ring 96 is formed of aluminum, the gasket 94 is formed of an elastomeric material such as "VITON" elastomer, and the sealing lip 92 is formed of a wear-resistant polymer material such as "TURCON" or "TURCITE" polymer compounds.

Figure 5:
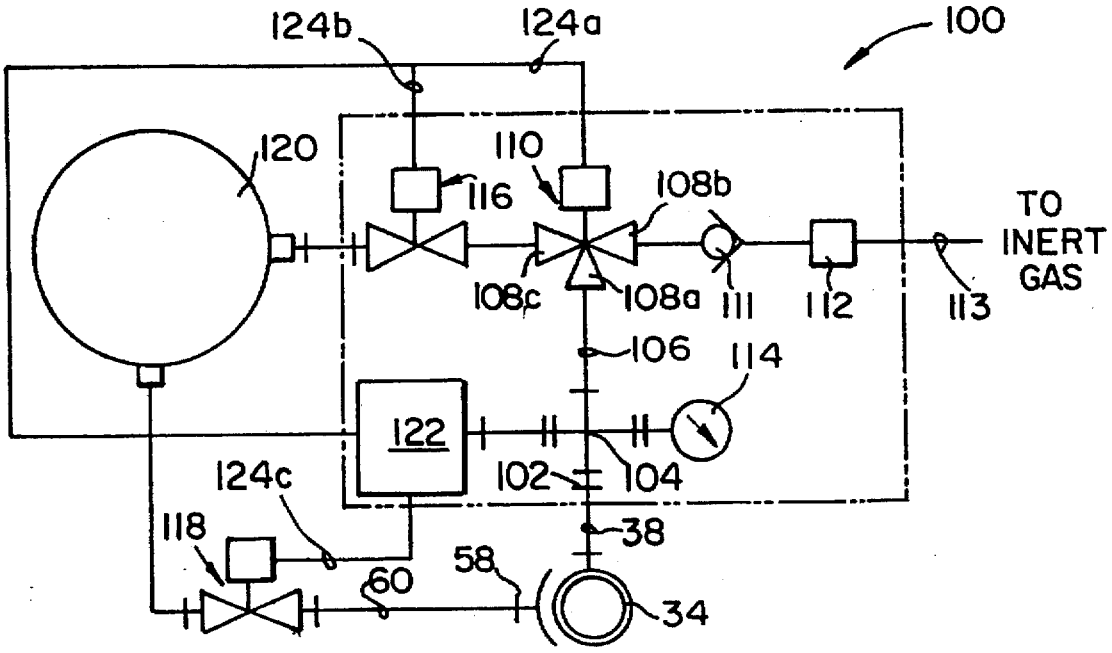
FIG. 5 is a schematic diagram of a pneumatic system for inflating and deflating the inflatable seal used in the dual seal arrangement shown in FIG. 3.

Referring now to FIG. 5 there is shown a pneumatic subsystem 100 for inflating and deflating the inflatable seal 34. The interior of inflatable seal 34 is connected through the inlet/outlet tube 38 to a first leg of a cross pipe fitting 104 by means of a standard connector 102. The cross fitting 104 has a second leg connected to a pipe section 106 which is connected to a first port **108*a* of a solenoid valve 110. A second port 108*b* of solenoid valve 110 is connected to a pressurized source of inert gas through a check valve 111 in line with a pressure regulator 112 and nylon tubing 113** which is connected to the inert gas reservoir of the vacuum furnace (not shown). It will be appreciated that compressed air from a separate source can be used instead of the pressurized inert gas.

A pressure gauge 114 is connected to a third leg of cross fitting 104 for monitoring the pressure in the inflatable seal 34. The ports of a second solenoid valve 116 are connected in line between a third port 108*c* of solenoid valve 110 and a vacuum line 120 of the vacuum furnace. The ports of a third solenoid valve 118 are connected between the vacuum line 120 and the vacuum tubing 60 and fitting 58 which communicate with the annular chamber 54. A controller 122 is provided for controlling the operation of solenoid valves 110, 116 and 118 to inflate or deflate the inflatable seal 34. The controller 122 includes a pressure switch (not shown) that is connected pneumatically to the fourth leg of cross fitting 104. Electrical conductors 124*a*, 124*b*, and 124*c*, connect the pressure switch with the solenoids of solenoid valves 110, 116, and 118, respectively for providing electrical control signals thereto for operating the solenoid valves.

The operation of a vacuum heat treating furnace in accordance with the present invention will now be described. When a work load of metallic parts has been loaded into the chamber 13 of the vacuum furnace 10, the pressure vessel 12 is sealed. The typical heat treating cycle includes evacuating the chamber 13 to a desired subatmospheric pressure, while heating the work load up to the heat treating temperature, maintaining the work load at the heat treating temperature for a selected amount of time, and then shutting of the heating system. The chamber 13 is then backfilled with an inert gas, and when the pressure in the chamber 13 reaches a second preselected subatmospheric pressure, the motor 20 is activated to drive the circulating fan 18 to circulate the inert gas over the work load and across the heat exchanger.

The fan 18 does not operate during the heating/evacuation step and the drive shaft 22 is thus in a static condition during that period of the heat treating cycle. Solenoid valve 110 is operated to open the first port 108*a* and the second port 108*b* to permit the pressurized inert gas to flow into and inflate the inflatable seal 34 such that it contacts the surface 81 of sealing surface sleeve 76 about its entire circumference. The pressure in the inflatable seal 34 is increased to a pressure that is selected to provide sufficient force against the surface 81 of sealing surface sleeve 76 to form a vacuum-tight seal. In practice, it has been found that a pressure of about 60 psi is sufficient for achieving the desired vacuum-tight seal.

Solenoid valve 118 is operated to open a path between the annular chamber 54 and the vacuum line 120. In this manner, the annular chamber 54 is maintained at a subatmospheric pressure which reduces the pressure differential across the inflatable seal 34, thereby improving the effectiveness of the inflatable seal.

At the end of the vacuum heating cycle, the furnace chamber 13 is backfilled with the inert gas. When the pressure in the chamber reaches a preselected level, preferably about 5 in. Hg, solenoid valve 110 is operated to close the second port 108*b*, thereby disconnecting the inflatable seal 34 from the inert gas source, and to open the third port 108*c*. At the same time solenoid valve 118 is operated to close, thereby disconnecting annular chamber 54 from the vacuum line 120. Concurrently, solenoid valve 116 is operated to open, thereby establishing a connection between the inflatable seal 34 and vacuum line 120. In this manner, the inflatable seal 34 is deflated and retracts from the surface 81 of the sealing surface sleeve 76. Once the inflatable seal 34 is fully retracted, the drive shaft 22 is free to rotate when the fan motor 20 starts.

While the circulating fan 18 is operating and drive shaft 22 is rotating, the pressure of the inert gas in the furnace chamber 16 is raised to the desired level, e.g., 2 bar, 6 bar, or higher. The lip seals 40, 46, and 50 remain in constant contact with the sealing surface 81 to maintain an effective pressure-tight seal about the drive shaft 22.

It will be recognized by those skilled in the art that changes and modifications may be made to the above-described invention without departing from the broad inventive concepts thereof. It is understood, therefore, that the invention is not limited to the particular embodiments disclosed herein, but includes all modifications and changes which are within the scope of the invention as defined in the appended claims.

What is claimed is:

1. A vacuum heat treating furnace comprising:

a pressure vessel having a wall that defines a chamber;

a fan disposed inside said chamber for circulating a cooling gas therein;

motive means disposed externally to said pressure vessel for driving said fan;

a driveshaft interconnecting said fan and said motive means through an opening in the wall of said pressure vessel; and a dual seal for providing a vacuum-tight seal and a gas-tight seal around said drive shaft, said dual seal comprising:

i) an inflatable seal surrounding said drive shaft for providing a vacuum-tight seal around said drive shaft when inflated, said inflatable seal comprising a ring-shaped, expandable tube, means communicating with the interior of said tube for inflating said tube, and means communicating with the interior of said tube for deflating said tube when inflated; and ii) a lip seal surrounding said drive shaft adjacent to said inflatable seal for providing a gas-tight seal around said drive shaft.

2. A vacuum heat treating furnace as set forth in claim 1 wherein said motive means comprises an electric motor and a mechanical linkage for coupling said electric motor to said drive shaft.

3. A vacuum heat treating furnace as set forth in claim 1 wherein said lip seal comprises:

a ring-shaped casing;

a ring-shaped sealing lip retained within said ring-shaped casing, said ring-shaped sealing lip having an inner circumference that is in contact with said drive shaft; and a spacing ring in juxtaposition with said ring-shaped sealing lip in said ring-shaped casing for restraining said ring-shaped sealing lip against lateral movement within said ring-shaped casing.

4. A vacuum heat treating furnace as set forth in claim 3 wherein said lip seal comprises a ring-shaped gasket disposed between said ring-shaped sealing lip and said spacing ring for providing a pressure-tight seal therebetween.

5. A vacuum heat treating furnace as set forth in claim 1 comprising a seal retainer attached to said pressure vessel wall for holding said dual seal in position adjacent to said drive shaft.

6. A vacuum heat treating furnace as set forth in claim 5 wherein said seal retainer has a central opening formed therein, said central opening being defined by a cylindrical wall having a first circumferential recess formed therein for receiving said lip seal and a second circumferential recess formed therein adjacent to said first recess for receiving said inflatable seal.

7. A vacuum heat treating furnace as set forth in claim 5 comprising tubing for conducting a cooling medium, said tubing being disposed adjacent to said dual seal in the furnace for cooling said dual seal during operation of the heat treating furnace.

8. A vacuum heat treating furnace as set forth in claim 7 comprising a metallic plate affixed to said seal retainer and a coil of said tubing is attached to said metallic plate for conducting a cooling fluid.

9. A vacuum heat treating furnace as set forth in claim 8 further comprising a metallic sleeve attached to said metallic plate and surrounding a portion of said drive shaft and a second coil of said tubing attached to said metallic sleeve for conducting the cooling fluid.

10. A vacuum heat treating furnace as set forth in claim 1 wherein said drive shaft comprises a sealing surface sleeve surrounding a portion of said drive shaft adjacent said dual seal and disposed between said drive shaft and said dual seal for providing a contact surface for said dual seal.

11. A vacuum heat treating furnace as set forth in claim 10 wherein said sealing surface sleeve comprises a surface layer of a hard, wear resistant material, said surface layer having a highly finished surface.

12. A vacuum heat treating furnace as set forth in claim 1 wherein said lip seal is located inboard of said inflatable seal and said dual seal comprises a second lip seal surrounding said drive shaft adjacent to said inflatable seal for providing a second gas-tight seal, said second lip seal being located outboard of said inflatable seal.

13. A vacuum heat treating furnace as set forth in claim 12 wherein said dual seal comprises a third lip seal surrounding said drive shaft adjacent to said second lip seal for providing a third gas-tight seal, said third lip seal being located outboard of said of said second lip seal.

14. In a vacuum heat treating furnace having a pressure vessel that includes a wall defining a chamber, and a fan disposed inside said chamber for circulating a cooling gas therein, a fan drive system comprising:

an electric motor disposed externally to said chamber;

a drive shaft coupled to said electric motor for interconnecting said fan and said electric motor through an opening in the wall of said pressure vessel; and a dual seal for providing a vacuum-tight seal and a gas-tight seal between said drive shaft and said pressure vessel wall, said dual seal comprising:

i) an inflatable seal surrounding said drive shaft for providing a vacuum-tight seal around said drive shaft when inflated, said inflatable seal comprising a ring-shaped, expandable tube means communicating with the interior of said tube for inflating said tube, and means communicating with the interior of said tube for deflating said tube when inflated; and ii) a lip seal surrounding said drive shaft adjacent to said inflatable seal for providing a gas-tight seal around said drive shaft.

15. A fan drive system for a vacuum heat treating furnace as set forth in claim 14 wherein said lip seal comprises:

a ring-shaped casing;

a ring-shaped sealing lip retained within said ring-shaped casing, said ring-shaped sealing lip having an inner circumference that is in contact with said drive shaft; and a spacing ring in juxtaposition with said ring-shaped sealing lip in said ring-shaped casing for restraining said ring-shaped sealing lip against lateral movement within said ring-shaped casing.

16. A fan drive system for a vacuum heat treating furnace as set forth in claim 15 wherein said lip seal comprises a ring-shaped gasket disposed between said ring-shaped sealing lip and said spacing ring for providing a pressure-tight seal therebetween.

17. A fan drive system for a vacuum heat treating furnace as set forth in claim 14 comprising a seal retainer attached to said pressure vessel wall for holding said dual seal in position adjacent to said drive shaft.

18. A fan drive system for a vacuum heat treating furnace as set forth in claim 17 wherein said seal retainer has a central opening formed therein, said central opening being defined by a cylindrical wall having a first circumferential recess formed therein for receiving said lip seal and a second circumferential recess formed therein adjacent to said first recess for receiving said inflatable seal.

19. A fan drive system for a vacuum heat treating furnace as set forth in claim 17 comprising tubing for conducting a cooling medium, said tubing being disposed adjacent to said dual seal in the furnace for cooling said dual seal during operation of the heat treating furnace.

20. A fan drive system for a vacuum heat treating furnace as set forth in claim 19 comprising a metallic plate affixed to said seal retainer and a coil of said tubing attached to said metallic plate for conducting a cooling fluid.

21. A fan drive system for a vacuum heat treating furnace as set forth in claim 20 further comprising a metallic sleeve attached to said metallic plate and surrounding a portion of said drive shaft and a second coil of said tubing attached to said metallic sleeve for conducting the cooling fluid.

22. A fan drive for a vacuum heat treating furnace as set forth in claim 14 wherein said drive shaft comprises a sealing surface sleeve surrounding a portion of said drive shaft adjacent said dual seal and disposed between said drive shaft and said dual seal for providing a contact surface for said dual seal.

23. A fan drive system for a vacuum heat treating furnace as set forth in claim 22 wherein said sealing surface sleeve comprises a surface layer of a hard, wear resistant material, said surface layer having a highly finished surface.

24. A fan drive system for a vacuum heat treating furnace as set forth in claim 14 wherein said lip seal is located inboard of said inflatable seal and said dual seal comprises a second lip seal surrounding said drive shaft adjacent to said inflatable seal for providing a second gas-tight seal, said second lip seal being located outboard of said inflatable seal.

25. A fan drive system for a vacuum heat treating furnace as set forth in claim 24 wherein said dual seal comprises a third lip seal surrounding said drive shaft adjacent to said second lip seal for providing a third gas-tight seal, said third lip seal being located outboard of said of said second lip seal.

* * * * *